US007062786B2

(12) United States Patent
Stinton

(10) Patent No.: US 7,062,786 B2
(45) Date of Patent: Jun. 20, 2006

(54) GARMENT WITH RELEASABLE WATER-TIGHT SEAL FOR NECK AND LIMBS

(75) Inventor: Robert T. Stinton, Lakeside, CA (US)

(73) Assignee: Diving Unlimited International, Inc., a California corporation, San Diego, CA (US)

( * ) Notice: Subject to any disclaimer, the term of this patent is extended or adjusted under 35 U.S.C. 154(b) by 278 days.

(21) Appl. No.: 10/118,740

(22) Filed: Apr. 9, 2002

(65) Prior Publication Data

US 2003/0188368 A1 Oct. 9, 2003

(51) Int. Cl.
*B63C 11/04* (2006.01)

(52) U.S. Cl. ..... 2/2.15; 2/2.17; 2/2.16

(58) Field of Classification Search ..... 2/2.15, 2/2.16, 2.17
See application file for complete search history.

(56) References Cited

U.S. PATENT DOCUMENTS

| | | | | | |
|---|---|---|---|---|---|
| 2,034,637 | A | * | 3/1936 | Mooney | 2/2.15 |
| 2,626,602 | A | * | 1/1953 | Buie | 128/201.27 |
| 3,000,014 | A | * | 9/1961 | White | 2/270 |
| 3,534,408 | A | * | 10/1970 | Fifield | 2/2.17 |
| 3,918,131 | A | | 11/1975 | Ausnit | 24/201 |
| 4,479,268 | A | | 10/1984 | Tillbrook | 2/2.1 R |
| 4,558,467 | A | * | 12/1985 | Barditch | 2/2.17 |
| 5,048,249 | A | * | 9/1991 | Shreiner et al. | 52/396.07 |
| 5,351,369 | A | | 10/1994 | Swain | 24/304 |
| 5,492,108 | A | | 2/1996 | Smith et al. | 128/201 |
| 5,513,407 | A | | 5/1996 | Reinert | 8/158 |
| 5,548,842 | A | | 8/1996 | Wiseman | 2/69 |
| 5,603,648 | A | | 2/1997 | Kea | 441/106 |
| 5,628,067 | A | | 5/1997 | Meyer et al. | 2/125 |
| 5,685,015 | A | | 11/1997 | Aldridge | 2/81 |
| 5,742,936 | A | | 4/1998 | Trone | 2/2.15 |
| 5,787,502 | A | * | 8/1998 | Middleton | 2/69 |
| 5,802,609 | A | * | 9/1998 | Garofalo | 2/2.17 |
| 5,924,134 | A | | 7/1999 | Taylor et al. | 2/81 |
| 5,933,865 | A | | 8/1999 | Aldridge | 2/81 |
| 5,978,960 | A | | 11/1999 | Wrightman | 2/2.15 |
| 6,029,274 | A | | 2/2000 | Welchel et al. | 2/69 |
| 6,032,285 | A | | 3/2000 | Densen | 2/2 |
| 6,038,700 | A | | 3/2000 | Aldridge et al. | 2/81 |
| 6,209,144 | B1 | | 4/2001 | Carter | 2/458 |
| 6,253,389 | B1 | | 7/2001 | Scaglione | 2/456 |
| 6,263,509 | B1 | | 7/2001 | Bowen | 2/69 |
| 6,286,144 | B1 | | 9/2001 | Henderson et al. | 2/69 |
| 6,415,440 | B1 | * | 7/2002 | Stinton | 2/2.17 |
| 6,415,449 | B1 | * | 7/2002 | Duplock | 2/275 |

FOREIGN PATENT DOCUMENTS

| | | |
|---|---|---|
| EP | 0 406 193 A | 10/1984 |
| FR | 2597 756 A | 10/1987 |
| WO | WO 98 54990 A | 12/1998 |

* cited by examiner

*Primary Examiner*—John J. Calvert
*Assistant Examiner*—Robert Muromoto
(74) *Attorney, Agent, or Firm*—Michael H. Jester

(57) ABSTRACT

A diver's suit, survival suit, or a suit worn to protect a worker from hazardous materials is provided with releasable water-tight seals around the wrists, ankles and/or neck. Each releasable water-tight seal includes first and second complementary shaped annular interlocking seal members preferably extruded from a first polymeric material. Gaskets made of a second softer polymeric material may be co-extruded with the first polymeric material and are compressed when the seal members are mated in order to enhance the impermeability of the resulting seal to liquids or gases.

9 Claims, 3 Drawing Sheets

GARMENT WITH RELEASABLE WATER-TIGHT SEAL FOR NECK AND LIMBS

FIELD OF THE INVENTION

The present invention relates to protective garments, and more particularly, to diver's suits, survival suits, hazardous materials suits and the like.

BACKGROUND OF THE INVENTION

There are many types of garments that must substantially cover the body and provide water-tight seals around the wrists, neck and/or ankles. Typically they comprise a one-piece suit body made of a waterproof material that includes an upper torso portion with sleeves for the arms and a lower trousers portion for enclosing the legs. Water-tight seals are provided around the terminal ends of the sleeves and trousers, and the hands and feet are normally covered by gloves and boots. Such garments usually have a neck opening, a water-tight neck seal and a hood or helmet. An example of such a garment is an underwater diving suit known as a dry suit. The diver wears fabric clothing under the dry suit for warmth, and the water-tight seals prevent the ingress of cold water. Dry suits typically have a large diagonal opening in the front thereof to make them easier to put on and take off. This opening is sealed by a water-tight zipper.

So-called survival suits may have a similar construction, and allow a person to withstand extreme cold water conditions for as much as six to eight hours while awaiting rescue. Suits of this general type are also worn by persons who must enter areas where hazardous chemicals or biological agents are present. Such "HAZMAT" suits require that the seals be gas-tight as well, or positive internal air pressure may be used to prevent the ingress of any harmful agents through the wrist, ankle and/or neck seals.

Gluing the gloves directly to the sleeves and the boots directly to the pants is not a desirable approach because tears cannot be easily repaired. Therefore, dry suits typically use tapered seals around the wrists and legs that are made from neoprene or dipped latex rubber. The gloves and boots are then separately donned and doffed. However, these tapered seals can degrade over time due to exposure to ultraviolet light from the sun and ozone from pollution. They can also tear. When this happens, expensive repairs are required, which are difficult, if not impossible, to make in the field. Furthermore, where dry suits are used for training, the tapered seals must be cut at the appropriate length to accommodate the physical size of the user. This means that the suit cannot be re-used by a person of a different size.

One prior art approach involves the use of a rigid ring around the wrist, ankle and neck. The sleeve, pants leg and upper torso portions of the suit can then overlap the adjacent ring along with the corresponding glove, boot or hood. An O-ring or other stretchable member then encircles the overlapping suit portions and squeezes them together to provide water-tight seals. But such seals are very difficult to put on, and they are uncomfortable because the stiff ring does not flex and yield with body movement.

Prior art dive suits with watertight seals around the diver's neck and extremities do not allow the hood, gloves and boots to be readily removed when the diver leaves the water so that he or she can still wear the suit, achieve cooling ventilation, perform critical activities and then easily and rapidly re-don the hood, gloves and boots. For example, it would be desirable for U.S. Navy Seal Team forces to be able to leave the water in their dry suits, perform a clandestine operation on land after removing their hoods, gloves and boots. They need to be able to put these suit elements back on in rapid fashion in order to escape into the water undetected.

SUMMARY OF THE INVENTION

In accordance with the present invention a waterproof protective garment is provided in the form of at least a portion of a suit body made of a waterproof material. The suit body has sleeves and/or pants legs each having a terminal end. A releasable water-tight seal is coupled to the end of each sleeve and/or pants leg and includes a first seal member permanently secured in a water-tight fashion to the sleeve or pants leg and a second seal member that is permanently secured in a water-tight fashion to a suit element in the form of a tapered seal, a glove or a boot. The first and second seal members are each dimensioned for encircling a wrist or ankle and have complementary configurations for releasably interlocking to provide a water-tight seal between the sleeve or pants leg on the one hand, and a tapered seal, glove or boot on the other hand.

DESCRIPTION OF THE PREFERRED EMBODIMENT

Figure 1:
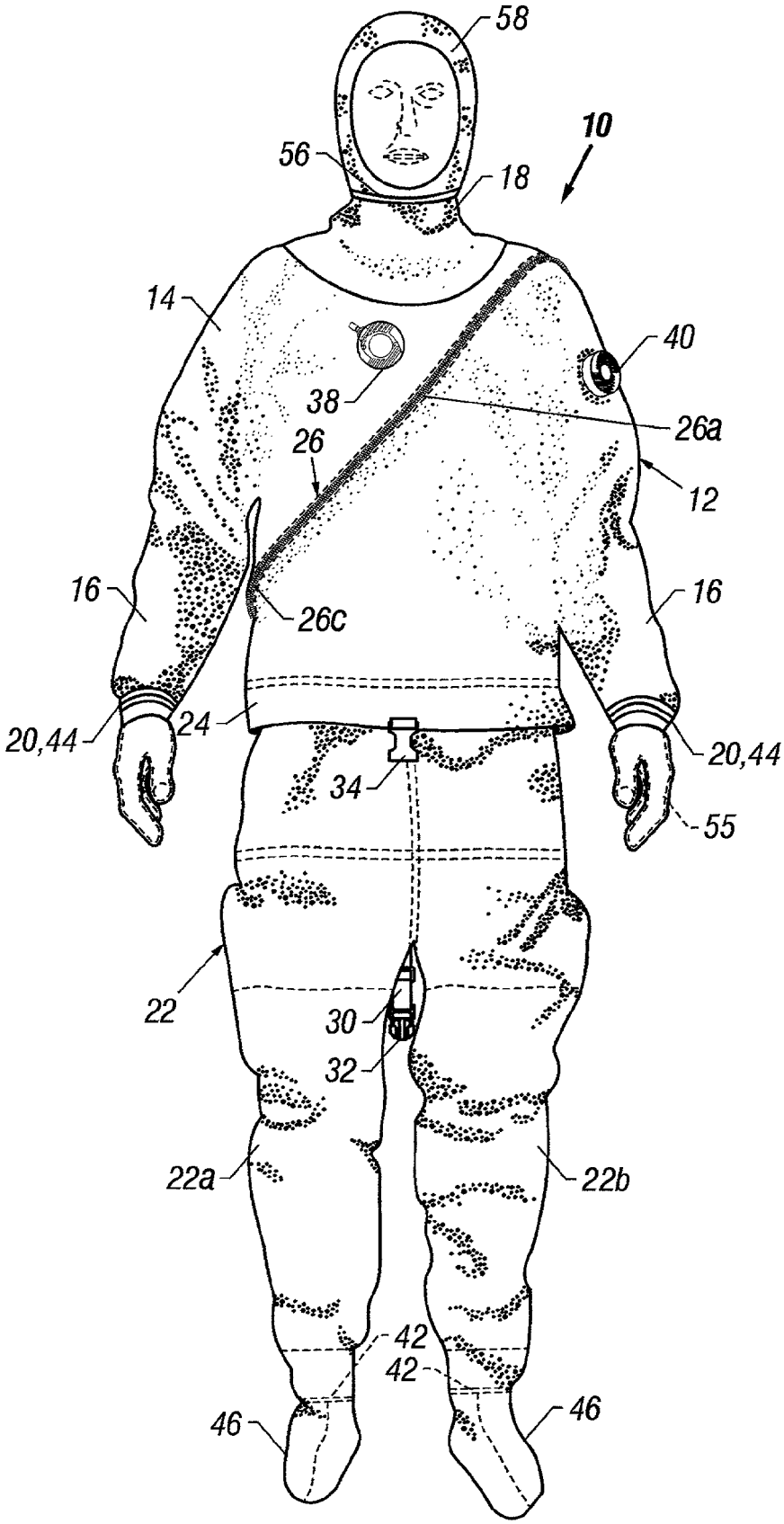
FIG. 1 is a front elevation view of a preferred embodiment of a diving suit in accordance with the present invention.
Figure 2:
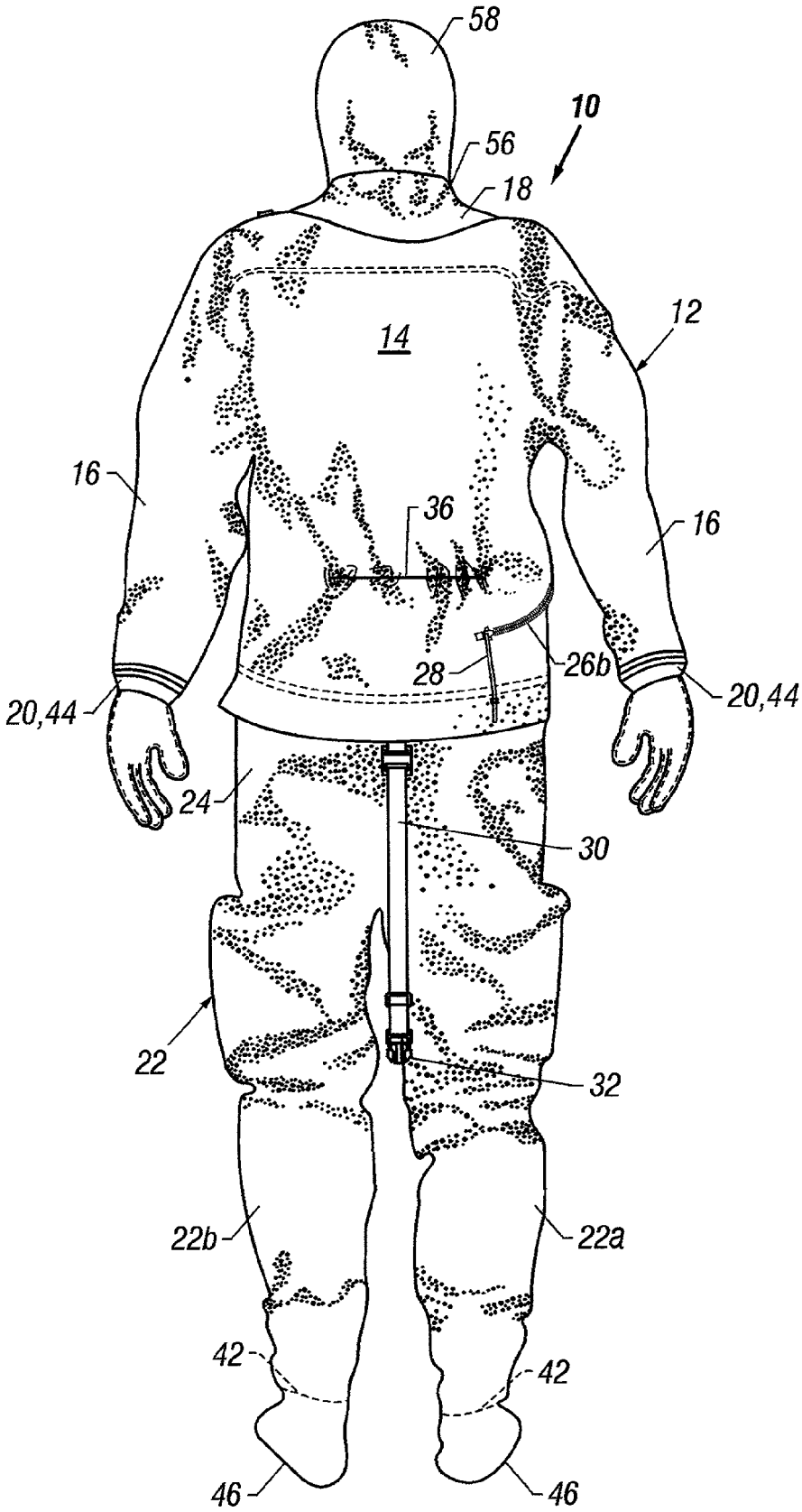
FIG. 2 is a rear elevation view of the diving suit of FIG. 1.

Referring to FIGS. 1 and 2 a diving suit 10 has a suit body 12 made of a suitable waterproof material. The suit body 12 has an upper torso portion 14 configured for enclosing an upper torso of a diver. The upper torso portion 14 includes a pair of sleeves 16 for enclosing the diver's arms and an opening for the diver's neck defined by the upper part 18 of the torso portion. The suit body 12 further includes a first pair of releasable water-tight seals 20 each connected to a corresponding sleeve end. The suit body 12 has a lower trousers portion 22 for enclosing the diver's legs. The suit body 12 further includes an extended torso portion 24 connecting the upper torso portion 14 and the trousers portion 22.

The upper torso portion 14 of the suit body 12 has an opening 26 sealed by a conventional waterproof zipper. An upper segment 26*a* of the opening extends diagonally across a front panel of the upper torso portion 14 from the left shoulder area of the upper torso portion 14 to a point near the right hip area. Preferably the upper end of the upper segment 26*a* of the zippered opening extends over the top of the left shoulder. A lower segment 26*b* of the opening partially encircles a waist area of the upper torso portion 14. The lower segment 26*b* (FIG. 2) of the zippered opening extends to a medial area of back panel of the upper torso portion 14 of the suit body 12. This increases the effective length of the opening and makes it easier for the diver to put on and take off the diving suit. The lower segment 26*b* of the zippered opening extends generally transverse to a longitudinal axis of the suit body 12. A curved segment 26*c* of the opening 26 connects the straight diagonal segment 26*a* with the waist encircling segment 26*b*. The waist area of the upper torso portion 14 of the suit body 12 is that part which generally overlies the area between the diver's hips and ribs. The zippered opening 26 does not cross the diver's waist so that the waterproof zipper is not kinked when the diver bends over or sits. The terminal portion of the upper segment 26*a* wraps partially around and over the left shoulder of the diver.

The suit body 12 could be made of fabric backed neoprene foam material that is cut into sections and glued and stitched together to form a wet suit. However, more preferably, the suit body 12 is made of a tri-laminate material consisting of an inner thin layer of synthetic rubber sandwiched between layers of woven Nylon fabric to provide a dry suit. The inner layer could be made of polyurethane. Any suitable waterproof material heretofore used to fabricate diving suits may be utilized including GORTEX® fabric and TEFLON® coated fabric. Suitable waterproof zippers are commercially available from YKK, New Zipper Company, EOB, Dynet and Taylon. A lanyard 28 (FIG. 2) has an inner end tied to the tab of the zipper slide. The diver can grasp the lanyard 28 with his or her right hand and pull the zipper slide from the right shoulder to the mid-lower back to close and seal the opening 26 along its entire length.

The diving suit 10 includes means for holding the extended torso portion 24 in a folded-over condition to configure the suit body 12 to conform to a height of the diver as is well known in the art. The extended torso portion 24 is folded up and inside the lower part of the upper torso portion 14 as needed to adjust to the diver's height. A crotch strap 30 (FIG. 2) has one end secured to the lower portion of the back panel of the upper torso portion 14. The other end of the strap 30 has a male plastic coupling 32 of the type used on back packs that can be releasably snapped into a female coupling 34 (FIG. 1) secured to the lower portion of the front panel of the upper torso portion 14. Alternatively, the diving suit 10 can be provided with holding means in the form of a pair of releasable suspenders and mating couplers, as disclosed in the aforementioned U.S. Pat. No. 4,464,795 of Long et al., the entire disclosure of which is hereby incorporated by reference.

Referring to FIG. 2, the back panel of the upper torso portion 14 of the suit body 12 has a gathered portion 36. An elastic cord (not visible) extends between the layers of the laminate fabric material that makes up the back panel of the upper torso portion 14, through grommets (not visible) secured in the fabric material and is tied into knots at each end. This arrangement helps keep the waist portion of the suit body 12 snug against the diver's waist.

Referring to FIG. 1 a conventional air inlet valve 38 is secured in the front panel of the upper torso portion 14. It is releasably connected to an air line to allow the interior of the suit body 12 to be partially inflated for comfort adjustment and buoyancy control. A conventional manually activated air release valve 40 allows air to be vented from the interior of the suit body 12 for comfort adjustment and buoyancy control. Further details of the construction of the diving suit 10 may be found in my co-pending U.S. patent application Ser. No. 10/032,050 filed Dec. 20, 2001, now U.S. Pat. No. 6,415,440 B1, the entire disclosure of which is hereby incorporated herein by reference.

The sleeves 16 of the upper torso portion 14 and the pants legs 22*a* and 22*b* of the lower trousers portion 22 each comprise tubular portions of the diving suit 10. The sleeves 16 and pants legs 22*a* and 22*b* have terminal ends that are coupled to releasable water-tight seals 20 and 42, respectively. In the preferred embodiment of my invention, the releasable seals 20 releasably connect the terminal ends of the sleeves 16 to tapered seals 44 that fit tightly around the diver's wrists. The tapered seals 44 have a frusto-conical shape. They have a conventional construction and are made of neoprene of dipped latex rubber. The terminal ends of the tapered seals 44 may be cut off at the desired length for proper sizing to the diver's wrist. The second pair of releasable water-tight seals 42 releasably connect the terminal ends of the pants legs 22*a* and 22*b* to boots 46 that are worn on the diver's feet.

Figure 4:
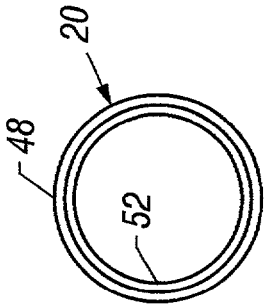
FIG. 4 is a cross-section of the releasable water-tight seal of FIG. 3 taken along line 4—4 of FIG. 3 illustrating its annular configuration. This figure is not drawn to scale in order to illustrate the mating of the inner and outer seal members.
Figure 3:
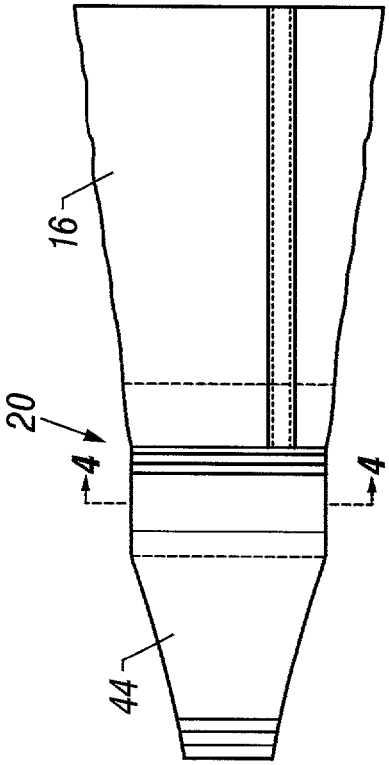
FIG. 3 is an enlarged, fragmentary side elevation view of one of the releasable seals of the diving suit of FIGS. 1 and 2 connecting the terminal end of one of the sleeves to one of the tapered seals that fits tightly around one of the diver's wrists.
Figure 5:
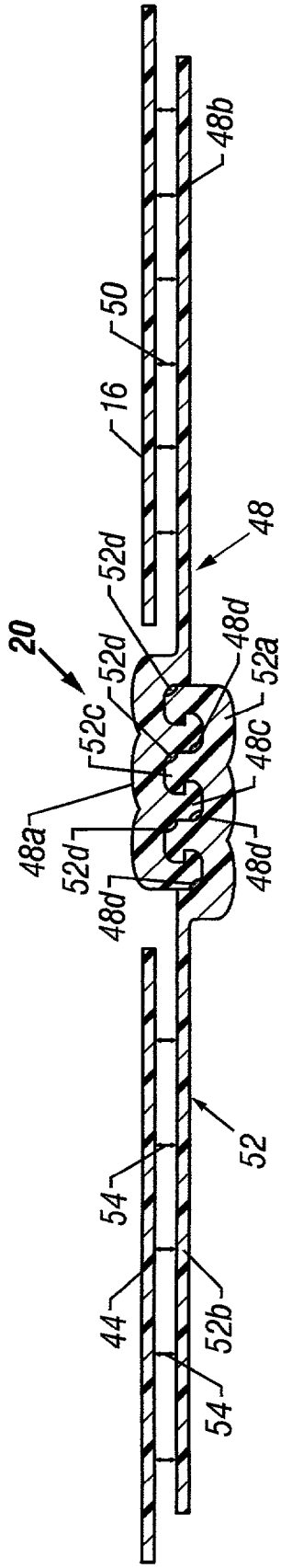
FIG. 5 is a greatly enlarged, fragmentary, longitudinal sectional view of the releasable water-tight seal of FIG. 3 illustrating further details of its construction.

The releasable water-tight seals 20 and 42 (FIGS. 1 and 2) have a similar construction and therefore only one of the releasable seals 20 need be described in detail. FIG. 3 is an enlarged, fragmentary side elevation view of the releasable seal 20 connecting the terminal end of one of the sleeves 16 to one of the tapered seals 44 that fits tightly around one of the diver's wrists. FIG. 4 is a cross-section of the releasable seal 20 illustrating its annular configuration. FIG. 5 is an enlarged fragmentary longitudinal sectional view of the releasable seal 20 illustrating further details of its construction.

The releasable seal 20 (FIG. 5) includes a first generally circular seal member 48 that is permanently secured in a water-tight fashion to the inside surface of the terminal end of a corresponding one of the sleeves 16 using a suitable adhesive illustrated diagrammatically by a plurality of vertical arrows 50. The releasable seal 20 includes a second generally circular seal member 52 that is permanently secured in a water-tight fashion to the inside surface of a corresponding tapered seal 44 using a suitable adhesive illustrated diagrammatically by a plurality of vertical arrows 54. The first seal member 48 and the second seal member 52 have an annular or ring-like configuration and are each dimensioned for loosely encircling the diver's wrist.

The first and second releasable water-tight seal members 48 and 52 (FIG. 5) have complementary configurations for releasably interlocking to provide a water-tight seal between the sleeve 16 and the corresponding tapered seal 44. The seal member 48 has a marginal strip portion 48*a* and a web portion 48*b*. The web portion 48*b* is glued to the sleeve 16. The marginal strip portion 48*a* has three hook-shaped ribs 48*c* that define three channels therebetween. The seal member 52 has a construction identical to that of the seal member 48. The seal member 52 has a marginal strip portion 52*a* and a web portion 52*b*. The web portion 52*b* is glued to the tapered seal 44. The marginal strip portion 52*a* has three hook-shaped ribs 52*c* that define channels therebetween. The ribs 48*c* and 52*c* are complementary to the channels so that they may releasably lock together to provide an interference fit. The undercut hook shape of the ribs 48*c* and 52*c* ensures that they are retained within their corresponding channels and will not inadvertently release. The web portion 48*b* and the sleeve 16 may be glued together with suitable adhesive 50 such as Clifton UR1087 and AquaSeal™ sealant. The adhesive 54 that holds the web portion 52*b* and the tapered seal 44 together may be the same as the adhesive 50.

Preferably the ribs 48*c* and 52*c* of the seal members 48 and 52 are formed of a first harder polymeric material and gaskets 48*d* and 52*d* are integrally formed on the ribs out of a second softer polymeric material. The gaskets 48*d* and 52*d* are substantially compressed when the seal members are joined. This compression provides a moisture-resistant seal between the ribs 48*c* and 52*c* and the juxtaposed channels. The gaskets could also be formed on the exterior walls of the channels. Preferably the seal members 48 and 52 are made of extruded segments or lengths of material, which are cut to the desired length and glued end-to-end to form rings. One suitable fastener for use in fabricating the seal members 48 and 52 is disclosed in U.S. Pat. No. 5,351,369 of Swain, granted Oct. 4, 1994 and assigned to Illinois Tool Works, Inc., the entire disclosure of which is hereby incorporated by reference. These fasteners are made of extruded, flexible polymeric materials and are commercially available under the trademark U-Maxigrip®.

The marginal strip portions 48*a* and 52*a*, the web portions 48*b* and 52*b*, the ribs 48*c* and 52*c*, and the channels that receive the ribs 48*c* and 52*c* may all be integrally extruded from a first polymeric material preferably having a hardness in the range of from about 60 durometer to about 95 durometer. The gaskets 48*d* and 52*d* may be co-extruded out of a second polymeric material compatible for the purposes of co-extrusion and bonding with the first polymeric material. The second polymeric material preferably has a hardness in the range of about 20 durometer to about 55 durometer. The first polymeric material may be low to medium density polyethylene, or polypropylene or polyurethane. The second polymeric material may be thermoplastic rubber, styrene ethylene butydene styrene block copolymer. One suitable adhesive for gluing these commercially available fasteners end-to-end is UPACO 0406, commercially available from the Adhesive Division of Workmen Industries of Nashua, N.H. Preferably a primer is applied to the plastic fastener before adhesive bonding of the abutting ends, one suitable primer being UPACO 3244B.

The ends of the seal members 48 and 52 could also be joined by sonic or radio frequency welding. In addition, the web portion 52*b* could be co-molded to the tapered seal 44. Alternatively, the seal member 52 could be molded first, then placed on a tapered mandrel, and then dipped into liquid latex material one or more times to form the tapered seal 44.

Surprisingly, I have discovered that in order to achieve the best results in terms of ease of mating and un-mating of the seal members 48 and 52, they should each have substantially the same diameter, even though the seal member 52 fits inside of the seal member 48. This arrangement also ensures that a water-tight seal will be achieved. This is counter-intuitive as it would seem that the inner seal member 52 would have to be made at least one or two percent smaller in diameter in order to fit within the outer seal member 48. The engaged seal members 48 and 52 have been found to provide a water tight seal in a dive suit worn by a diver descending to a depth of thirty meters and more. Any air trapped between the ribs 48*c* and 52*c* and the walls of the juxtaposed channels is compressed and the seal members 48 and 52 grip each other more tightly as the diver descends.

Those skilled in the art will appreciate that in the broadest sense my invention contemplates that a terminal end of a tubular portion of the suit body 12 that surrounds a limb can be releasably connected in a water-tight fashion to a suit element such as the tapered seal 36, a glove 55 or a boot 46. A releasable water-tight neck seal 56 (FIGS. 1 and 2) has a construction similar to that of the seals 20 and 42 releasably attaches a hood 58 to the upper torso portion 14 of the suit body 12.

While I have described a preferred embodiment of my diver's suit, it will be apparent to those skilled in the art that my invention my be modified in arrangement and detail. My invention could be implemented in a separate torso portion or in a separate trousers portion, i.e. in a two-piece suit. The sleeves 16 could be releasably connected to the tapered seals 16 or to gloves (not illustrated). The pants legs 22*a* and 22*b* could similarly be releasably connected to tapered seals that surround the ankles, or to boots. My invention is applicable to other one-piece garments besides diver's suits, such as survival suits, hazardous materials suits, and so forth. The configuration of the seal members 48 and 52 could be varied considerably. They need not have the precise triple undercut rib, triple channel construction or the integral sealing gaskets. A wide variety of interlocking seal configurations will suffice for the purpose of providing a releasable water-tight seal. Therefore, the protection afforded my invention should only be limited in accordance with the scope of the following claims.

I claim:

1. A waterproof protective garment, comprising:

at least a portion of a suit body made of a waterproof material and having elongate tubular portions for enclosing a pair of limbs of a person, each tubular portion having a terminal end that is coupled to a releasable water-tight seal including a first seal member connected in a water-tight fashion to the terminal end of the tubular portion and a second seal member that is connected in a water-tight fashion to a suit element selected from the group consisting of a tapered seal, a glove and a boot, the first and second seal members each being dimensioned for encircling the limb and having complementary configurations for releasably interlocking to provide a water-tight seal between the tubular portion of the suit body and the suit element, and wherein one of the first and second seal members has at least one undercut hook-shaped rib that mates with at least one complementary shaped channel in the other one of the first and second seal members to provide an interference fit including mating planar surfaces approximately parallel to the longate tubular portion so that the first and second seal members will not inadvertently release.

2. The garment of claim 1 wherein at least one of the seal members has a gasket that is compressed when the first and second seal members are interlocked to provide a moisture-resistant seal.

3. The garment of claim 1 wherein the first seal member is formed with a web portion to which the terminal end of the tubular portion of the suit body is permanently secured.

4. The garment of claim 1 wherein the second seal member is formed with a web portion to which the suit element is permanently secured.

5. The garment of claim 1 wherein the first and second seal members are formed of a polymer material selected from the group consisting of low to medium density polyethylene, polypropylene and polyurethane.

6. The garment of claim 2 wherein the gasket is made of a polymer material selected from the group consisting of thermoplastic rubber and styrene ethylene butydene styrene block copolymer.

7. The garment of claim 2 wherein the gasket is made of a polymer material that has a hardness in the range of about 20 durometer to about 55 durometer.

8. The garment of claim 5 wherein the polymer material of the seal members has a hardness in the range of about 60 durometer to about 95 durometer.

9. The garment of claim 1 wherein the first and second seal members have three ribs that each mate with a corresponding one of three channels.

* * * * *

UNITED STATES PATENT AND TRADEMARK OFFICE

CERTIFICATE OF CORRECTION

PATENT NO. : 7,062,786 B2
APPLICATION NO. : 10/118740
DATED : June 20, 2006
INVENTOR(S) : Robert T. Stinton It is certified that error appears in the above-identified patent and that said Letters Patent is hereby corrected as shown below:

In column 6, line 34 should be corrected as follows:
... surfaces approximately parallel to the ~~longate~~ <u>elongate</u> tubular ...

Signed and Sealed this

Fifth Day of September, 2006

JON W. DUDAS
*Director of the United States Patent and Trademark Office*